US011542075B2

(12) United States Patent
Kirsh

(10) Patent No.: US 11,542,075 B2
(45) Date of Patent: Jan. 3, 2023

(54) CHILD RESISTANT BOTTLE CLOSURE SYSTEM

(71) Applicant: Ross Kirsh, New York, NY (US)

(72) Inventor: Ross Kirsh, New York, NY (US)

(73) Assignee: Quark Distribution, Inc., New York, NY (US)

( * ) Notice: Subject to any disclaimer, the term of this patent is extended or adjusted under 35 U.S.C. 154(b) by 0 days.

(21) Appl. No.: 16/886,584

(22) Filed: May 28, 2020

(65) Prior Publication Data

US 2020/0377269 A1 Dec. 3, 2020

Related U.S. Application Data

(60) Provisional application No. 62/853,317, filed on May 28, 2019.

(51) Int. Cl.

| | |
|---|---|
| ***B65D 47/18*** | (2006.01) |
| ***B65D 50/00*** | (2006.01) |
| ***B05B 11/04*** | (2006.01) |

(52) U.S. Cl.

CPC ..... *B65D 47/18* (2013.01); *B05B 11/047* (2013.01); *B65D 50/00* (2013.01); *B65D 2203/04* (2013.01); *B65D 2215/00* (2013.01)

(58) Field of Classification Search

CPC ..... B56D 47/18; B01L 3/00; B01L 3/0217; B01L 3/5082; B01L 2300/028; B01L 2300/047; B65D 50/00; A61J 7/0053

USPC ..... 222/420, 421, 41, 47, 49; 141/22, 23, 141/25, 27

See application file for complete search history.

(56) References Cited

U.S. PATENT DOCUMENTS

| | | | | |
|---|---|---|---|---|
| 2,129,144 | A * | 9/1938 | Lancaster | G01F 11/025 141/23 |
| 4,383,618 | A * | 5/1983 | Dougherty | B65D 50/046 215/216 |
| 5,746,349 | A * | 5/1998 | Putteman | G01F 11/027 222/49 |
| 5,836,359 | A * | 11/1998 | Seidler | B05B 11/3001 141/23 |
| 6,112,779 | A * | 9/2000 | Camilla | A61J 1/2096 141/22 |
| 6,250,504 | B1 * | 6/2001 | Maffei | A61J 1/2096 141/381 |
| 6,273,152 | B1 * | 8/2001 | Buehler | A61M 5/1782 141/22 |
| 10,345,133 | B2 * | 7/2019 | Ham | B05B 11/02 |
| 2011/0284123 | A1 * | 11/2011 | Bouix | G01F 11/025 141/23 |
| 2013/0112314 | A1 * | 5/2013 | Lee | A45D 40/267 141/23 |
| 2013/0192713 | A1 * | 8/2013 | Drugeon | B65D 50/046 141/26 |

(Continued)

*Primary Examiner* — Lien M Ngo

(74) *Attorney, Agent, or Firm* — Meister Seelig & Fein LLP

(57) ABSTRACT

The present application provides a child-resistant liquid dispensing closure apparatus, which includes a plunger and pipet, and preferably a dosage measuring system that is integrated that appears as the plunger is withdrawn from the pipet. The closure may be used for a bottle containing a liquid for oral administration of solutions, syrups, suspensions, elixirs, tinctures, concentrates, and the like.

20 Claims, 11 Drawing Sheets

(56) References Cited

U.S. PATENT DOCUMENTS

| | | | | |
|---|---|---|---|---|
| 2014/0234007 | A1* | 8/2014 | Lee | A45D 40/26<br>401/121 |
| 2017/0231365 | A1* | 8/2017 | Choi | B05B 11/001<br>222/383.1 |
| 2018/0042363 | A1* | 2/2018 | Kim | A45D 34/045 |

* cited by examiner

CHILD RESISTANT BOTTLE CLOSURE SYSTEM

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

Field of the Invention

This application generally relates to a bottle closure, and in particular, a child-resistant liquid dispensing closure.

Description of the Related Art

The United States enacted the 1970 Poison Prevention Packaging Act ("PPPA") in response to a high number of children ingesting hazardous household products, from cleaning products to prescription drugs. The PPPA requires a number of household substances to be packaged in child-resistant packaging. The packaging required by the PPPA must be designed or constructed to be significantly difficult for children under five years of age to open within a reasonable time, and not difficult for normal adults to use properly. Since the regulation has been in effect, there have been remarkable declines in reported deaths from ingestions by children of toxic household products including medications.

The growth in demand for safety packaging is unleashing a wave of creativity among packaging makers as they look for ways to reinvent child-resistant designs and meet expanding market needs. Specifically, the rising use of highly concentrated oral liquid dosage forms for traditional and alternative medicine has brought increased scrutiny on the packaging of such products. From analgesics to *cannabis* to cosmetic serums, the need for liquid-specific packaging has pushed designers to think of ways to enhance compliance and user experience while minimizing design constraints.

BRIEF DESCRIPTION OF THE DRAWINGS

The invention is illustrated in the figures of the accompanying drawings which are meant to be exemplary and not limiting, in which like references are intended to refer to like or corresponding parts.

DETAILED DESCRIPTION OF THE INVENTION

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized and structural changes may be made without departing from the scope of the present invention. Likewise, a reasonably broad scope for claimed or covered subject matter is intended. Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of exemplary embodiments in whole or in part. The following detailed description is, therefore, not intended to be taken in a limiting sense.

Figure 1:
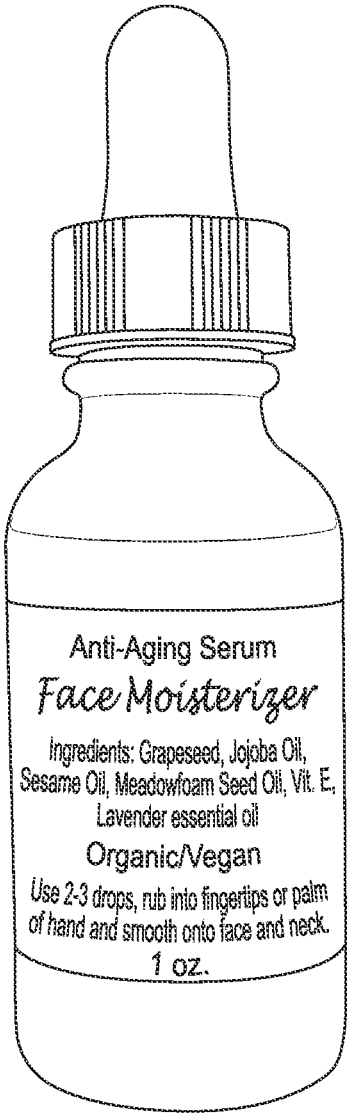
FIG. 1 (Prior Art)
FIG. 1 illustrates a conventional dropper bottle.
Figure 2:
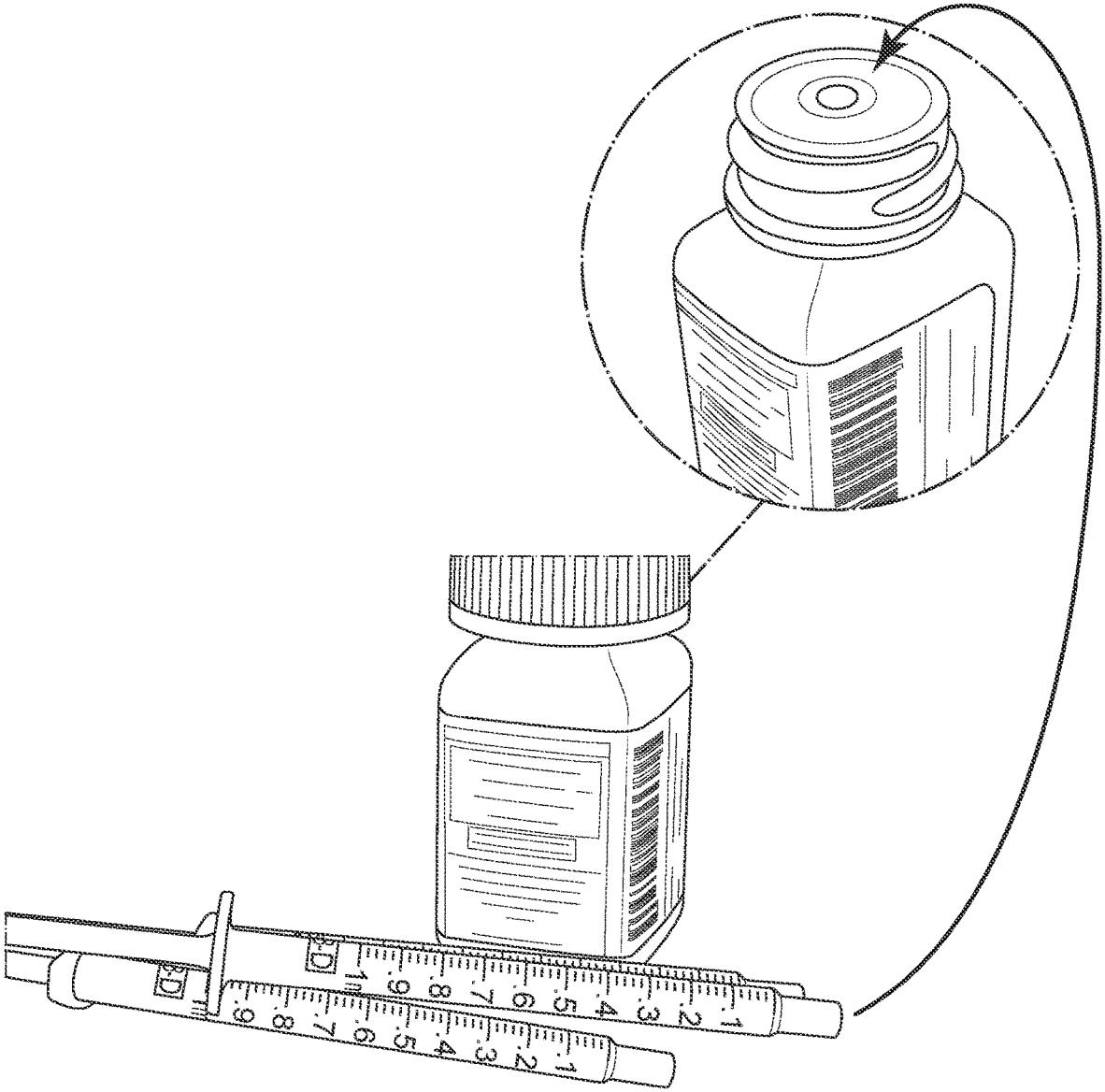
FIG. 2 (Prior Art)
FIG. 2 illustrates a conventional medication bottle for oral liquid dosage forms.

The present application discloses a child-resistant liquid dispensing closure apparatus. The apparatus may be used as a closure for a dropper bottle (such as the one illustrated in FIG. 1) or as a bottle for oral liquid dosage forms (such as the one illustrated in FIG. 2) including solutions, syrups, suspensions, elixirs, tinctures and concentrates, replacing the need for measuring devices such as a dropper, syringe, medicine cup, or dosing spoon to dose/administer. In some embodiments, the closure may include an integrated dosage measuring system.

Figure 3:
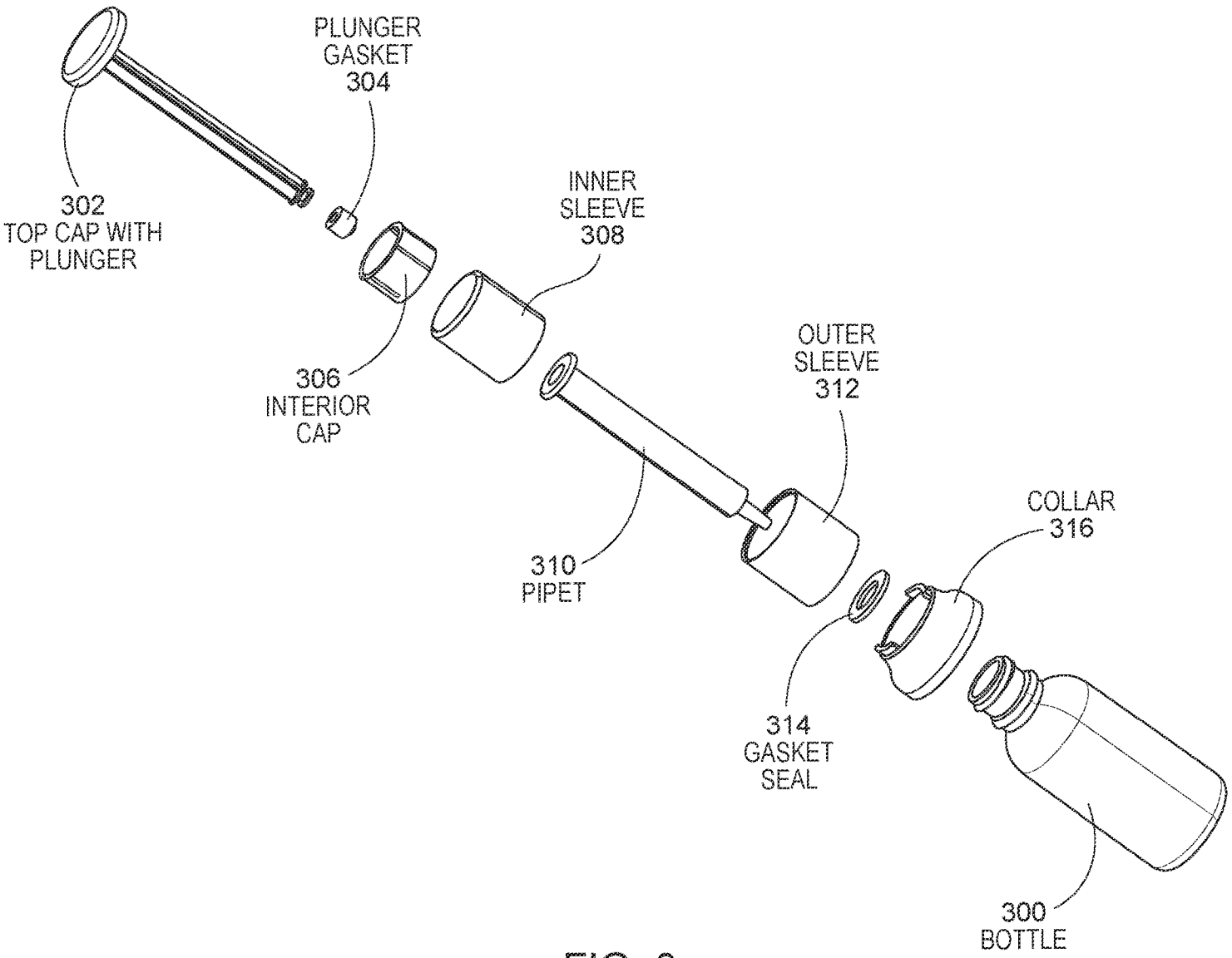
FIG. 3 illustrates an exploded view of a bottle closure system according to an embodiment of the present invention.

FIG. 3 illustrates an exploded view of a bottle closure system according to an embodiment of the present invention. A bottle closure system may be configured with a bottle 300. The bottle 300 may be, for example, a dropper bottle, a medicine bottle, a tincture bottle, etc., made from materials, such as glass and plastic.

The bottle closure system may comprise a plunger assembly including a top cap with plunger 302, plunger gasket 304, and inner sleeve 308. The top cap portion of the plunger 302 may comprise a disc-shaped flange to facilitate user handling of the top cap with plunger 302. The flange may include a larger surface area for contact by the user than a bare section of the plunger. The body of plunger 302 may include a rod that extends from the top cap portion to a distal end at a contact section. The contact section of plunger 302 may be coupled to a plunger gasket 304 for creating a seal when inserted into the body of pipet 310. Inner sleeve 308 may provide a stopper for the cap portion of top cap with plunger 302.

The bottle closure system further comprises a cap assembly that may be configured with the plunger assembly. The cap assembly may comprise an outer sleeve 312, an interior cap 306, a pipet 310, and gasket/seal 314. The inner sleeve 308 may further comprise an attachment point to a cap assembly. Inner sleeve 308 of the plunger assembly may include grooves and/or notches that can be interfaced with corresponding grooves and/or notches of the interior cap 306. The interior cap 306 is seated within outer sleeve 312 from the above-side cavity. The plunger assembly may be fitted on top of the cap assembly. Outer sleeve 312 may receive the inner sleeve 308 from the above-side such that inner sleeve 308 is positioned in between the interior cap 306 and the outer sleeve 312.

Figure 4:
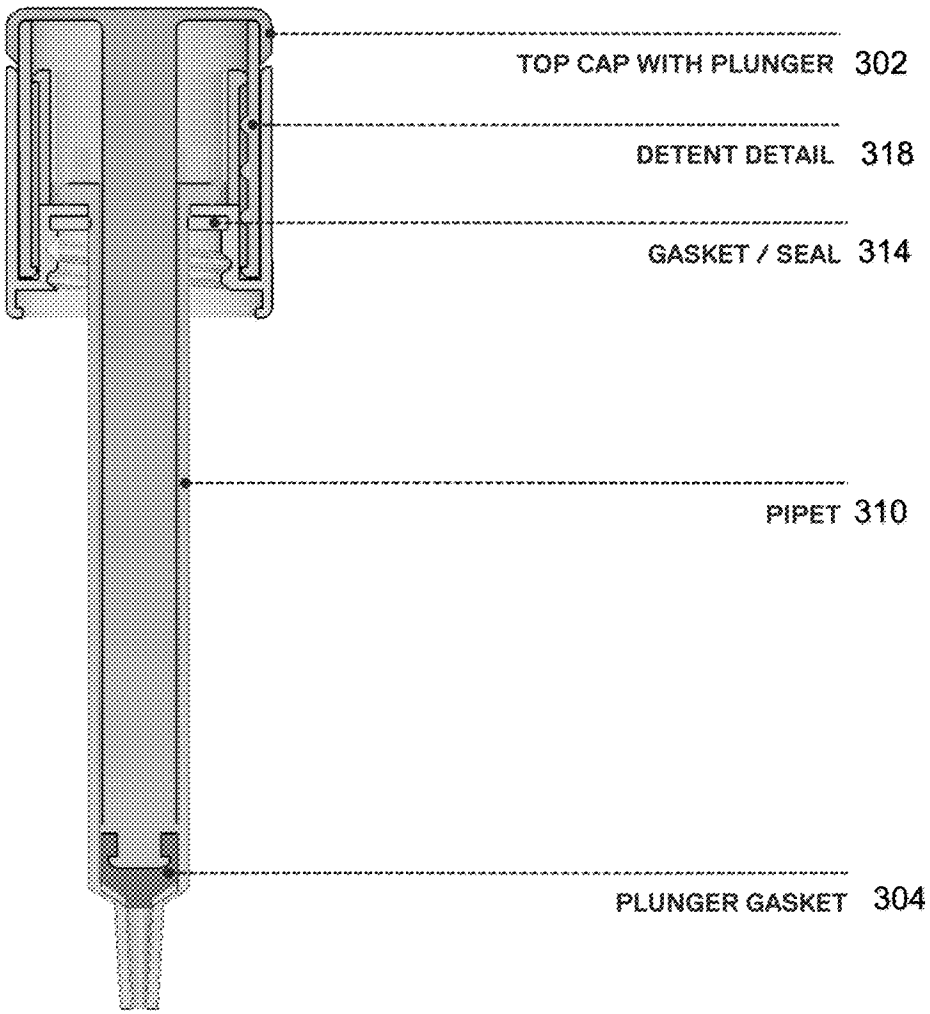
FIG. 4 illustrates a cross-section view of combined plunger and cap assemblies of a bottle closure system according to an embodiment of the present invention.

Pipet 310 is inserted through an orifice of outer sleeve 312 from the above-side cavity. The pipet 310 includes a collar that when inserted through the orifice from the above-side cavity, the collar rests on the outer circumference of the orifice of the outer sleeve 312. When the plunger assembly is fitted on top of the cap assembly, pipet 310 may provide a receptacle for receiving the body of top cap with plunger 302 through the top side of the pipet 310, as illustrated in FIG. 4. As such, top cap with plunger 302 may be configured within pipet 310 such that it can be retracted and protracted from pipet 310.

Figure 5:
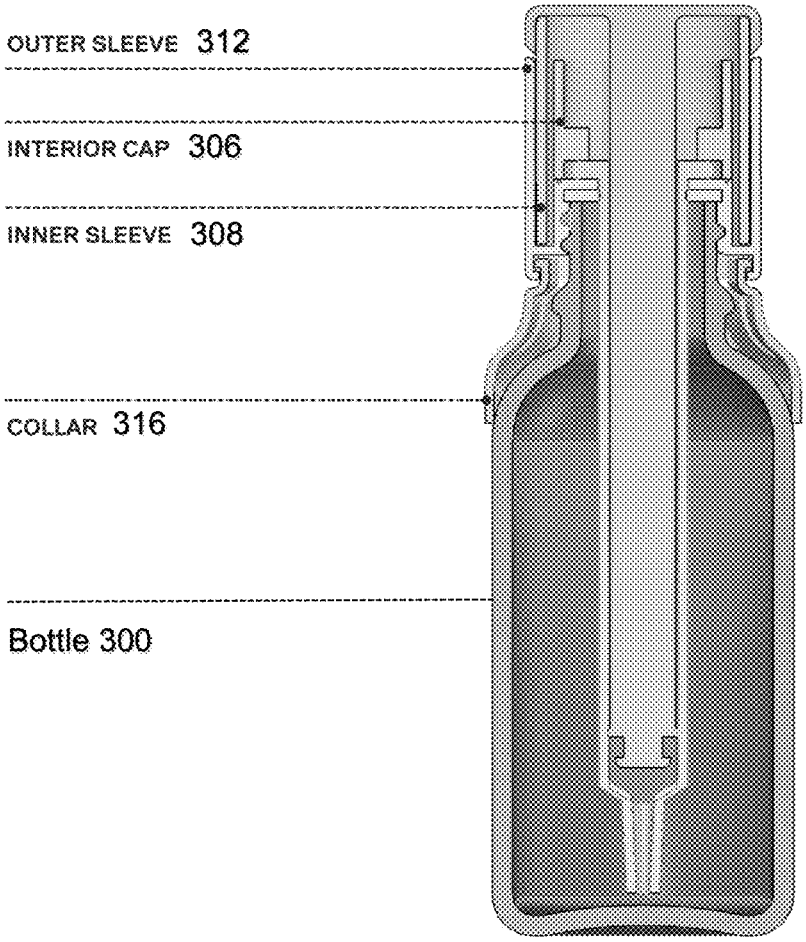
FIG. 5 illustrates a cross-section view of a bottle closure system according to an embodiment of the present invention.
Figure 6:
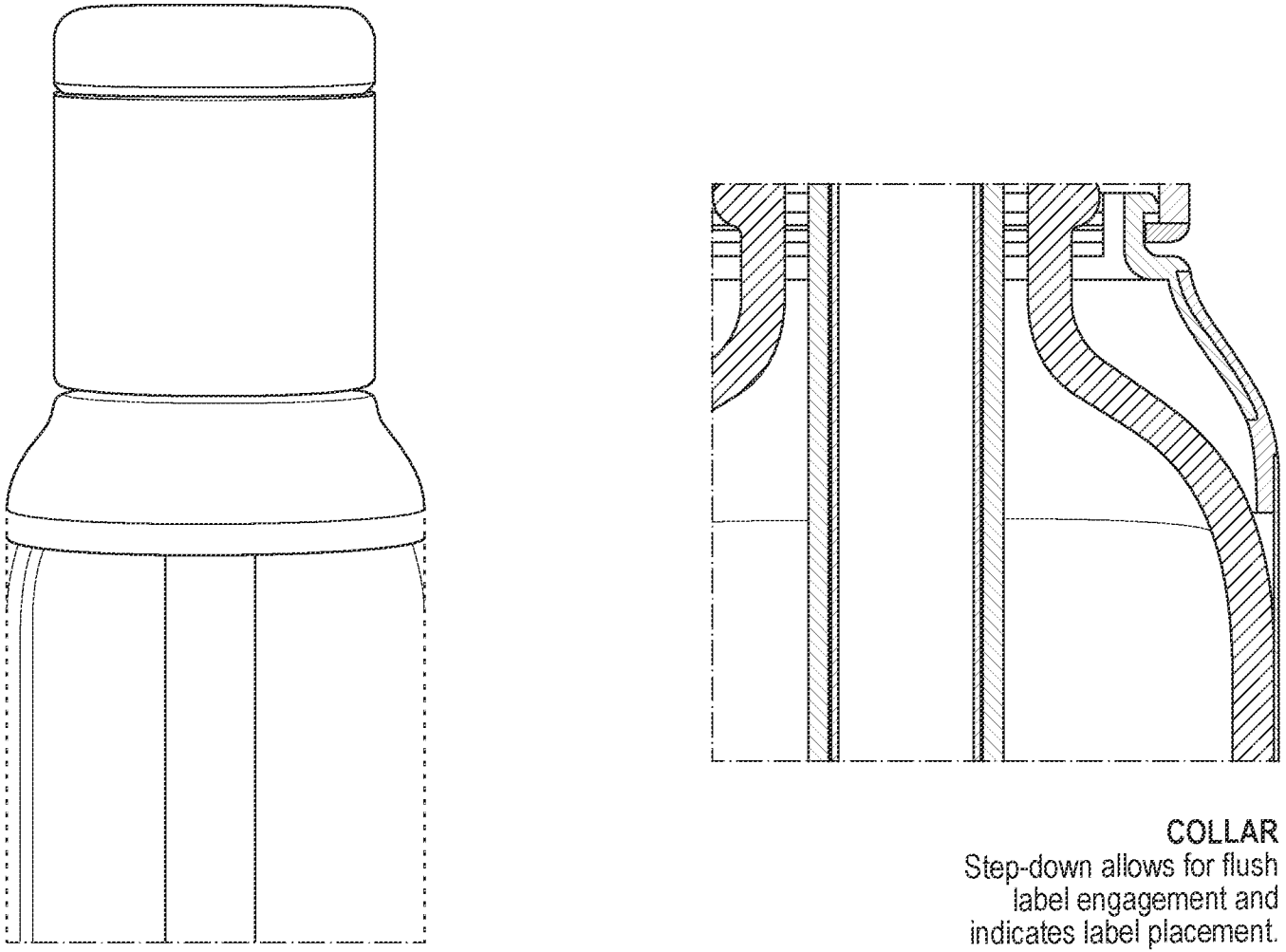
FIG. 6-11 illustrate a bottle closure system according to various embodiments of the present invention.
Figure 7:
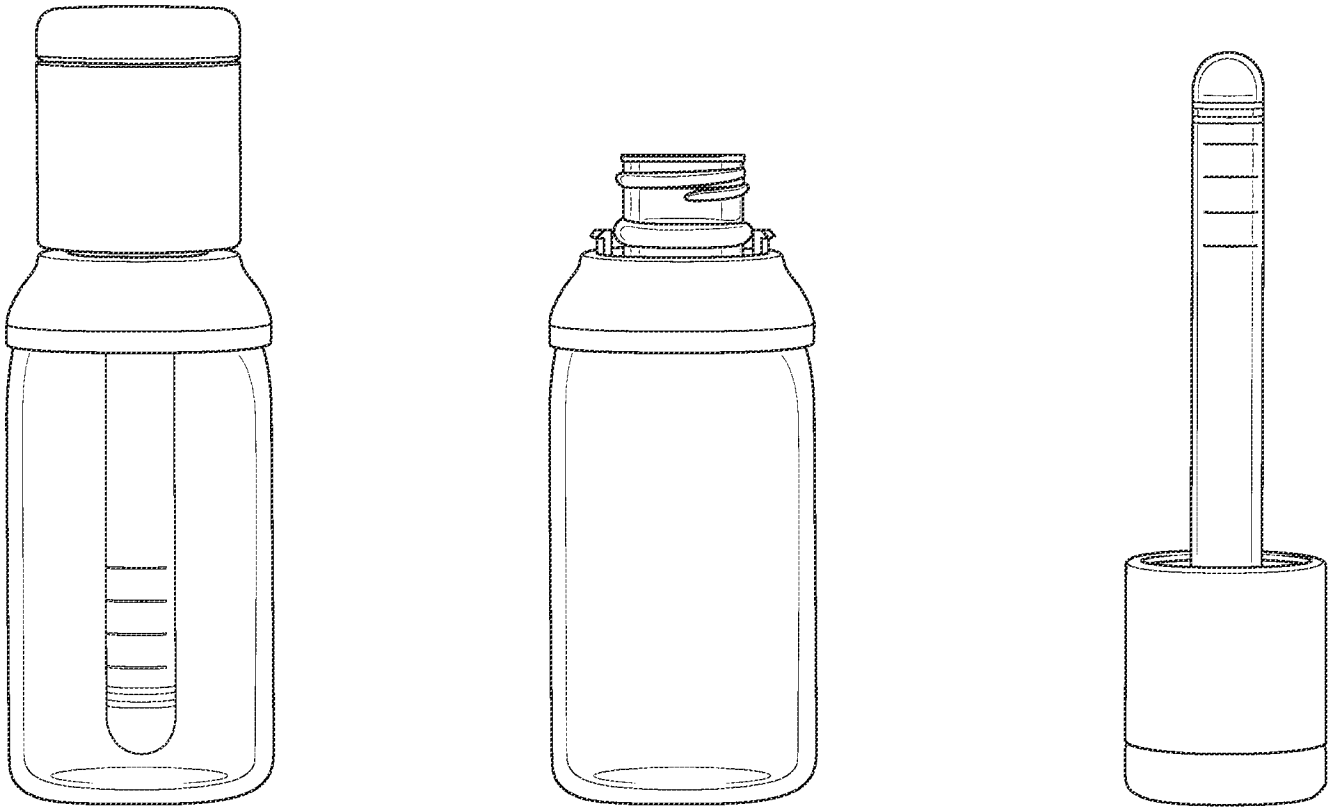
Figure 8:
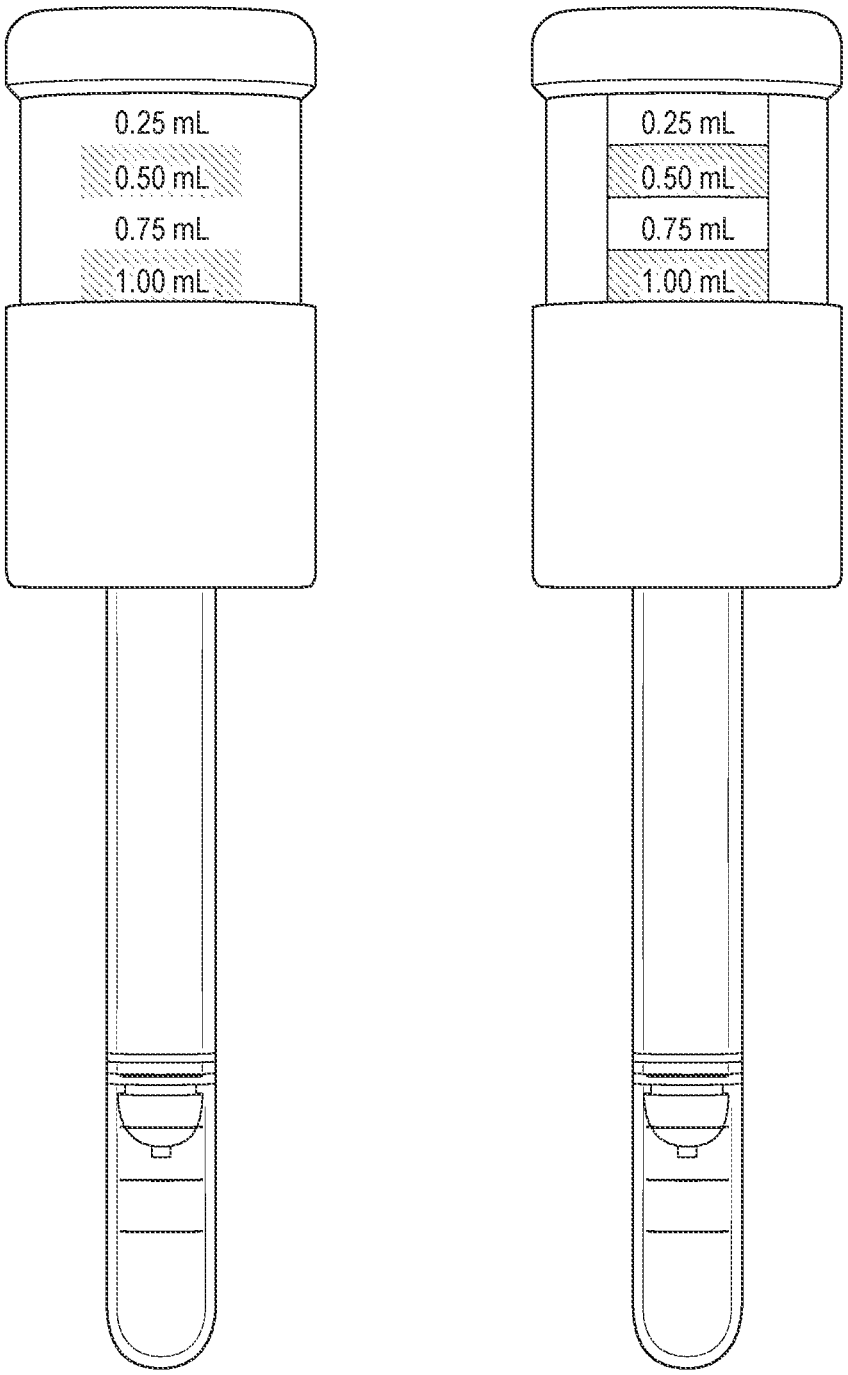
Figure 9:
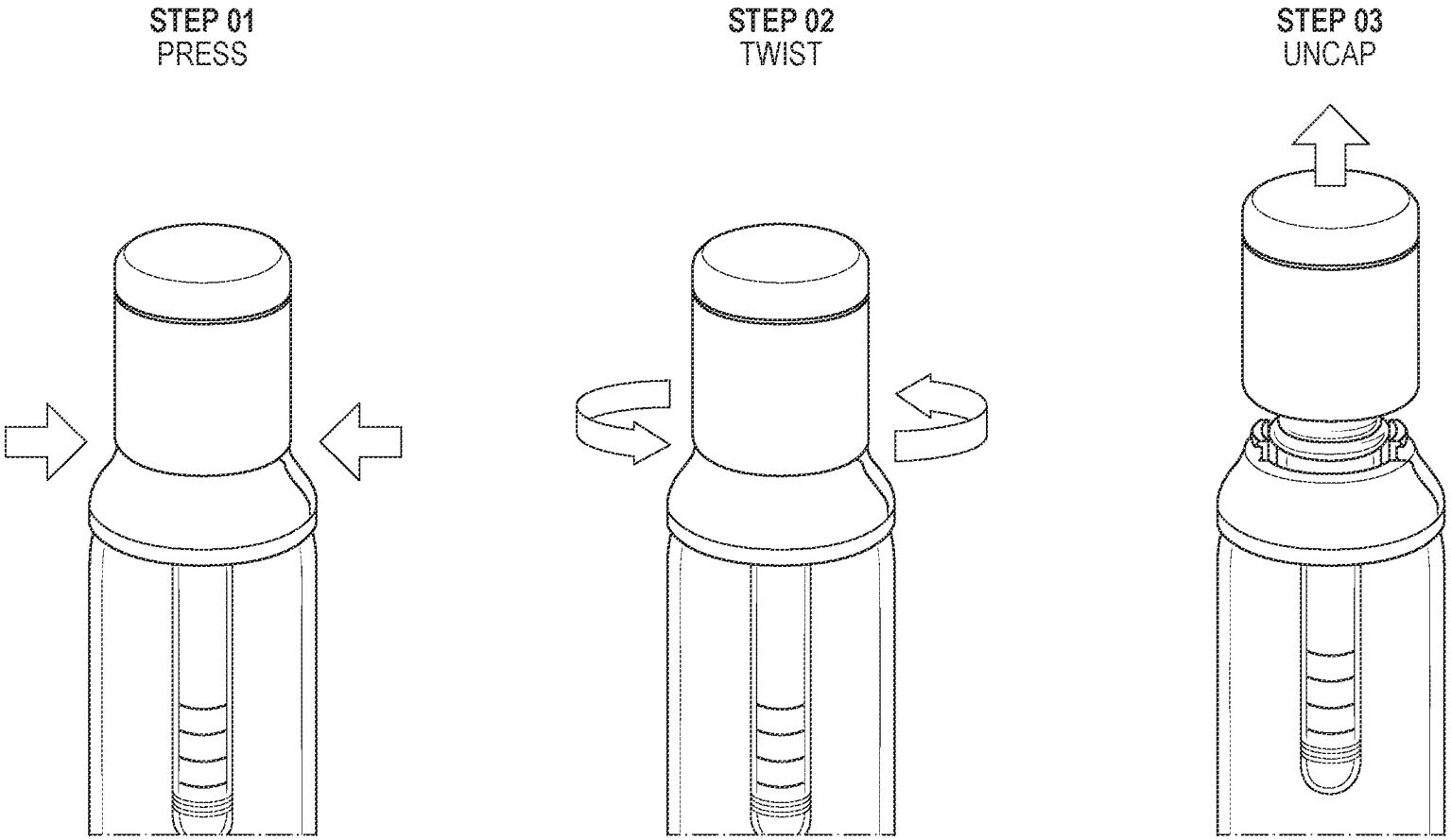
Figure 10:
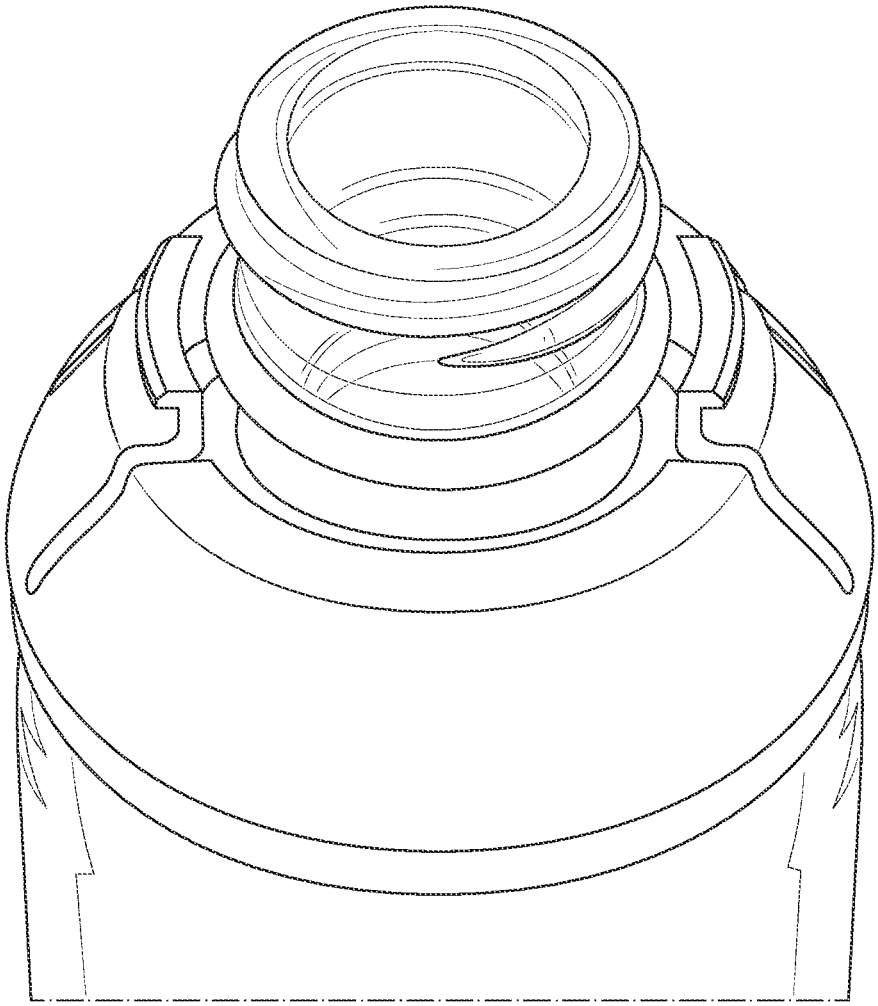
Figure 11:
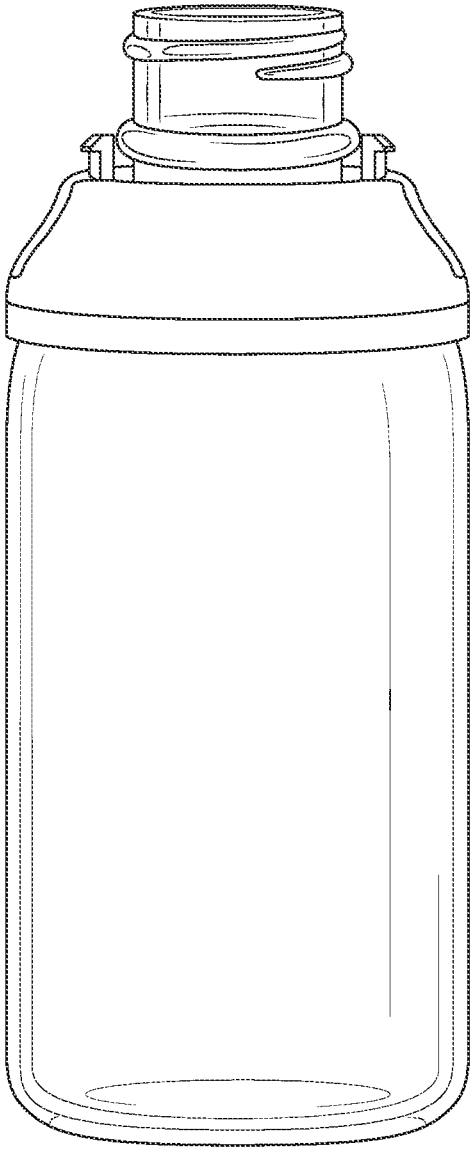

The underside cavity of outer sleeve 312 may be threaded to screw onto or otherwise attach to mouth of bottle 300. Outer sleeve 312 may further include a gasket 314 that can be placed between the underside cavity of outer sleeve 312 and the mouth of bottle 300 to provide a seal. When the outer sleeve 312 of the cap assembly is connected to the bottle 300, the pipet 310 (along with the plunger assembly) is inserted within the body of bottle 300, as illustrated in FIG. 5.

The outer sleeve 312 may further include a child-resistant feature. Prior to attaching the outer sleeve 312 to bottle 300, a collar 316 may be placed around the neck of the bottle 300 (screwed on, clipped on, or otherwise). The collar 316 may include locking clips for attaching to the outer sleeve 312 of the cap assembly. The cap assembly may be attached to the collar 316 using a child-resistant clip. Collar 316 may also provide additional tampering protection and create a seamless transition between the closure system and the bottle.

FIGS. 1 through 5 are conceptual illustrations allowing for an explanation of the present invention. Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

What is claimed is:

1. A bottle plunger assembly, comprising:
- a top cap,
- a plunger,
- a rod, wherein the rod connects the plunger to the top cap,
- a pipet, wherein the plunger is movable within the pipet to withdraw a measured amount of liquid from a bottle;
- a dosage measuring system that indicates the measured amount of liquid withdrawn from the bottle as the plunger is moved within the pipet;
- an inner sleeve including a stopper to the top cap, wherein the inner sleeve displays measurement indicia of the dosage measuring system; and
- an outer sleeve including threading for screwing onto a mouth of a bottle, wherein the outer sleeve is lockable to a collar that is positioned on a neck of the bottle, and wherein removal of the outer sleeve from the bottle is inhibited by the collar when locked.

2. The bottle plunger assembly of claim 1 wherein the rod extends from the top cap to a distal end at a contact section of the plunger.

3. The bottle plunger assembly of claim 2 wherein the contact section of the plunger is coupled to a plunger gasket that creates a seal within a body of the pipet.

4. The bottle plunger assembly of claim 1 wherein the pipet is housed in a cap assembly and the inner sleeve includes an attachment point to the cap assembly.

5. The bottle plunger assembly of claim 4 wherein the pipet is inserted through an orifice of an outer sleeve of the cap assembly.

6. The bottle plunger assembly of claim 5 wherein the outer sleeve includes a gasket at an underside cavity of the outer sleeve.

7. A bottle closure system, comprising:
- a top cap coupled to a plunger;
- a collar positioned on a neck of a bottle; and
- a cap assembly including:
  - a pipet including a receptacle for the plunger, wherein the plunger is movable within the pipet to withdraw a measurable amount of liquid from the bottle;
  - an inner sleeve including a stopper to the top cap, wherein the inner sleeve displays measurement indicia of the amount of liquid withdrawn from the bottle as the plunger is moved within the pipet; and
  - an outer sleeve that attaches the cap assembly to a child-resistant clip of the collar, the outer sleeve including threading for screwing onto a mouth of the bottle, wherein removal of the outer sleeve from the bottle is inhibited by the collar when locked.

8. The bottle closure system of claim 7 wherein the plunger includes a rod that extends from the top cap to a distal end at a contact section of the plunger.

9. The bottle closure system of claim 8 wherein the contact section of the plunger is coupled to a plunger gasket that creates a seal within a body of the pipet.

10. The bottle closure system of claim 7 wherein the inner sleeve includes an attachment point to the cap assembly.

11. The bottle closure system of claim 7 wherein the pipet is inserted through an orifice of the outer sleeve.

12. The bottle closure system of claim 7 wherein the outer sleeve includes a gasket at an underside cavity of the outer sleeve.

13. A bottle closure system, comprising:

a top cap coupled to a plunger;

a collar positioned on a neck of a bottle;

a cap assembly including:

a pipet including a receptacle for the plunger, wherein the plunger is movable within the pipet to withdraw a measurable amount of liquid from the bottle;

an inner sleeve including a stopper to the top cap;

an outer sleeve that attaches the cap assembly to a child-resistant clip of the collar, the outer sleeve including threading for screwing onto a mouth of the bottle, wherein removal of the outer sleeve from the bottle is inhibited by the collar when locked; and a dosage measuring system that indicates the measurable amount of liquid withdrawn from the bottle as the plunger is moved within the pipet, wherein measurement indicia of the dosage measuring system is displayed on the inner sleeve.

14. The bottle closure system of claim 13 wherein a contact section of the plunger is coupled to a plunger gasket that creates a seal within a body of the pipet.

15. The bottle closure system of claim 13 wherein the inner sleeve includes an attachment point to the cap assembly.

16. The bottle closure system of claim 13 wherein the pipet is inserted through an orifice of the outer sleeve.

17. The bottle closure system of claim 13 wherein the outer sleeve includes a gasket at an underside cavity of the outer sleeve.

18. The bottle plunger assembly of claim 1 wherein the inner sleeve is translatable relative to the outer sleeve based at least in part on the movement of the plunger relative to the outer sleeve.

19. The bottle plunger assembly of claim 7 wherein the inner sleeve is translatable relative to the outer sleeve based at least in part on the movement of the plunger relative to the outer sleeve.

20. The bottle plunger assembly of claim 13 wherein the inner sleeve is translatable relative to the outer sleeve based at least in part on the movement of the plunger relative to the outer sleeve.

* * * * *